United States Patent [19]

Whittle

[11] Patent Number: 4,604,219

[45] Date of Patent: Aug. 5, 1986

[54] METHOD OF PREPARING OVERBASED CALCIUM SULFONATES

[76] Inventor: Joanne R. Whittle, P.O. Box 1608, Port Arthur, Tex. 77641

[21] Appl. No.: 727,042

[22] Filed: Apr. 25, 1985

[51] Int. Cl.[4] ..... C10M 135/10

[52] U.S. Cl. ..... 252/25; 252/18; 252/33; 252/33.4

[58] Field of Search ..... 252/18, 25, 33, 33.4

[56] References Cited

U.S. PATENT DOCUMENTS 3,830,739 8/1974 Kemp ..... 252/33

4,192,758 3/1980 Dickey et al. ..... 252/18

4,235,810 11/1980 Osselet et al. ..... 252/33

4,543,194 9/1985 Spence et al. ..... 252/33

*Primary Examiner*—Jacqueline V. Howard

[57] ABSTRACT

In an overbased sulfonate process calcium hydroxide is formed in situ by the continuous and uniform addition of water to calcium oxide over the entire hydration and carbonation time rather than incrementally. It has been found that the water rate and amount are critical.

A 300 TBN product is formed with an $H_2O/CaO$ molar ratio of 0.4 and a 3 hour hydration time. A 400 TBN product is formed with an $H_2O/CaO$ molar ratio of 0.8 and 3 hour hydration time.

Improved filterability and raw material utilization as well as reduced by-product solids content is achieved.

5 Claims, No Drawings

METHOD OF PREPARING OVERBASED CALCIUM SULFONATES

BACKGROUND OF THE INVENTION

This invention is an improved method of preparing overbased calcium sulfonates which are used as detergent and reserve alkalinity lubricating oil additives.

DESCRIPTION OF THE PRIOR ART

In the course of operation, internal combustion engines convert lubricating oil to acidic degradation products. Those acidic degradation products attack and corrode engine parts and catalyze the formation of sludge, thereby reducing lubricity and accelerating wear of moving parts in contact with the lubricating oil.

It is desirable to add basic substances to the lubricating oil which neutralize acids as they are formed in the engine before they reach concentrations sufficient to cause corrosion or to catalyze the sludge reaction. Adding an alkalinity agent to the detergent in motor oil is known as overbasing. Colloidal carbonates of the alkaline earth metals have been found to be well suited for this purpose. These carbonate dispersions are stabilized by oil soluble surface active agents with the sulfonates of the alkaline earth metals in which the sulfonic acid portion of the molecule has a molecular weight of preferably 450 to 600. The sulfonates are made by sulfonation of lubricating oil fractions from petroleum and by sulfonation of alkyl benzenes having the desired molecular weight for this purpose. Benzene alkylates with straight chain alkyl groups are especially desirable.

U.S. Pat. No. 4,427,557 discloses an overbased sulfonate process in which a mixture of calcium hydroxide and calcium oxide are used. The solids content of the crude product is reduced without the use of an amine or ammonia promoter such as disclosed in U.S. Pat. No. 4,086,170 or overbasing in stages with solvent removal, water treatment and dehydration steps after each stage as disclosed in U.S. Pat. No. 3,878,116. The patent teaches that the mole ratio of calcium hydroxide to calcium oxide is critical to produce a bright and clear, oil soluble product. However, previous attempts to prepare overbases sulfonates by in situ hydration of calcium oxide have not been totally satisfactory.

SUMMARY OF THE INVENTION

The invention is an improved process for producing an overbased calcium sulfonate. Alkaline earth calcium sulfonates derived from natural or synthetic feedstocks or a mixture of both are overbased by diluting a neutral calcium sulfonate with a light hydrocarbon solvent in a molar ratio of solvent/neutral calcium sulfonate of about 1.0 to 2.0; and with a lower alkanol in a molar ratio of alkanol/calcium oxide of about 0.5 to 3.0. Then calcium oxide is mixed in a molar ratio of a calcium oxide/neutral calcium sulfonate of about 7 to 28 and the mixture heated to about 100° F. to 170° F. at 0 to 50 psig. Then carbon dioxide and water are added continuously at a uniform rate over 1 to 4 hour. The molar ratio of water/calcium oxide is 0.1 to 1.2 and molar ratio of calcium dioxide/calcium oxide is 0.6 to 0.9. The mixture is worked up and a micellar dispersion of calcium carbonate produce in the neutral calcium sulfonate.

DESCRIPTION OF THE PREFERRED EMBODIMENTS

In accordance with the present invention, alkaline earth calcium sulfonates derived from natural or synthetic feedstocks or a mixture of both can be overbased by introducing into a mixture comprising a neutral alkaline earth calcium sulfonate, a lower alcohol, a light hydrocarbon diluent carbon dioxide and water. The water is introduced continuously and at a uniform rate over 1–4 hours, preferably 1–3 hours into the heated mixture with carbon dioxide. Water is added in a molar ratio water/calcium oxide of 0.1 to 1.2 preferably 0.4 to 0.8. It has been found that both the water rate and amount are critical. It has been unexpectedly found that a superior product is formed by adding water continuously during carbonation rather than all charged in one or several increments at the beginning of the carbonation. By the present invention a high calcium sulfonate product with improved filterability and high clarity is formed with good lime utilization.

The operating parameters of the present process are tabulated in Table 1.

TABLE I

| | Variable | Operable Range | Preferred Range |
|---|---|---|---|
| 1. | Reaction Temperature, °F. | 100–170° | 130–150° |
| 2. | Pressure, psig | 0–50 | 0–20 |
| 3. | Mole ratio $H_2O/CaO$ | 0.1–1.2 | 0.4–0.8 |
| 4. | Mole ratio $CO_2/CaO$ | 0.6–0.9 | 0.8 |
| 5. | Hydrocarbon Solvent, wt % | 37–50 | 40–50 |
| 6. | Alcohol, wt % | 4.7–7.2 | 4.8–5.8 |
| 7. | Carbonation and Hydration Time, min | 60–240 | 60–180 |

Examples of useful and preferred reactants which may be employed in the practice of the invention are listed in Table II.

TABLE II

| Reactants | Example | Preferred Reactants |
|---|---|---|
| 1. Calcium Oxide | | One with a total slaking time of 4.5–35 minutes and a temperature rise of 6° C. max in the first 30 sec. as measured by ASTM C-100-76a. |
| 2. Calcium Sulfonate | Neutralized "sulfonic acid" derived from a natural feedstock. Neutralized "sulfonic acid" derived from a synthetic feedstock. Blends of neutralized sulfonic acids from natural and synthetic feedstocks. | Blends of neutralized sulfonic acids from natural and synthetic feedstocks. |
| 3. Diluent Oil | 100–500 SUS (@ 40 C) pale stock. 100–500 SUS solvent neutral oil. | 100 SUS pale stock hydrofinished |

TABLE II-continued

| Reactants | Example | Preferred Reactants |
|---|---|---|
| 4. Hydrocarbon Solvent | Straight run gasoline, dehexanized raffinate gasoline, normal or mixed hexanes, normal or mixed heptanes, benzene or toluene. | Crude heptane |
| 5. Lower alcohols | $C_1$–$C_5$ normal or branched chain alcohols. stock. | Methanol |

This invention is better shown by way of example.

EXAMPLE 1

Calcium sulfonate (291 g containing 42.4% active material) was diluted with a light hydrocarbon solvent (781 g) and methanol (100 g). To the diluted mixture was added calcium oxide (150 g). The mixture was stirred and heated to 140° F. and then gaseous carbon dioxide (92 g) and water (38 g) were introduced into the mixture over a three hour period. A 100–500 SUS (@ 40° C.) diluent oil (132 g) was then added. The crude reaction mixture contained 10 volume percent solids. The mixture was then filtered through diatomaceous earth and a filtration rate of 12.3 gal of 400 TBN product/hr-ft$^2$ was obtained. The filtrate was then heated to 250° F. to remove the solvent. The solvent-free filtrate (663 g) was bright and clear and had a TBN of 416, a calcium sulfonate content of 18.3, and a Kin Vis @ 100° C. of 137.25 cSt. The sulfonate utilization was 98.2% and the lime utilization was 91.9%.

EXAMPLE 2

Calcium sulfonate (601 g containing 42.4% active material) was diluted with a light hydrocarbon solvent (668 g) and methanol (92 g). To the diluted mixture was added calcium oxide (128 g). The mixture was stirred and heated to 140° F. and then gaseous carbon dioxide (79 g) and water (16.5 g) were introduced into the mixture over a two hour period. The crude reaction mixture contained 4.8 volume percent solids. The mixture was then filtered through diatomaceous earth and a filtration rate of 21.7 gal of 400 TBN product/hr-ft$^2$ was obtained. The filtrate was then heated to 250° F. to remove the solvent. The solvent-free filtrate (797 g) was bright and clear and had a TBN of 300, a calcium sulfonate content of 32.0, and a Kin Vis @ 100° C. of 347.8 cSt. The sulfonate utilization was 99.9% and the lime utilization was 93.3%.

Examples 3–10 show that the invention is superior to processes wherein (1) all calcium hydroxide is used (2) all calcium oxide is used (3) a mixture of calcium hydroxide and calcium oxide is used and (4) all the water is added immediately before the start of the carbonation.

EXAMPLE 3

Calcium sulfonate (291 g containing 42.4% active material) was diluted with a light hydrocarbon solvent (781 g) and methanol (100 g). To the diluted mixture was added calcium hydroxide (203 g). The mixture was stirred and heated to 140° F. and then gaseous carbon dioxide (92 g) was introduced into the mixture over a three hour period. A 100–500 SUS (@ 40° C.) diluent oil (132 g) was then added. The crude reaction mixture contained 25 volume percent solids which is more than twice as high as in Example 1. The mixture was then filtered through diatomaceous earth and a filtration rate of 12.9 gal of 400 TBN product/hr-ft$^2$ was obtained. The filtrate was then heated to 250° F. to remove the solvent. The solvent-free filtrate (615 g) was bright and clear and had a TBN of 383, a calcium sulfonate content of 18.4, and a Kin Vis @ 100° C. of 45.46 cSt. The sulfonate utilization was 91.6% and the lime utilization was 76.7% both of which are lower than that of Example 1.

EXAMPLE 4

Calcium sulfonate (291 g containing 42.4% active material) was diluted with a light hydrocarbon solvent (781 g) and methanol (100 g). To the diluted mixture was added calcium oxide (150 g). The mixture was stirred and heated to 140° F. and then gaseous carbon dioxide (92 g) was introduced into the mixture over a three hour period. A 100–500 SUS (@ 40° C.) diluent oil (132 g) was then added. The crude reaction mixture contained 6.5 volume percent solids. The mixture was then filtered through diatomaceous earth and a filtration rate of 3.02 gal of 400 TBN product/hr-ft$^2$ was obtained. The filtrate was then heated to 250° F. to remove the solvent and when this was done the solvent-free product was an oil insoluble solid. From tests on the diluted filtrate it was determined that the sulfonate utilization was 100% and the lime utilization was only 64.0%.

EXAMPLE 5

Calcium sulfonate (291 g containing 42.4% active material) was diluted with a light hydrocarbon solvent (781 g) and methanol (100 g). To the diluted mixture was added calcium oxide (30 g) and calcium hydroxide (163 g). The mixture was stirred and heated to 140° F. and then gaseous carbon dioxide (92 g) was introduced into the mixture over a three hour period. A 100–500 SUS (@ 40° C.) diluent oil (132 g) was then added. The crude reaction mixture contained 25 volume percent solids which was again more than twice as high as that obtained in Example 1. The mixture was then filtered through diatomaceous earth and a filtration rate of 7.25 gal of 400 TBN product/hr-ft$^2$ was obtained. The filtrate was then heated to 250° F. to remove the solvent. The solvent-free filtrate (649 g) was bright and clear and had a TBN of 395; a calcium sulfonate content of 17.3; and a Kin Vis @ 100° C. of 127.2 cSt. The sulfonate utilization was 91.0% and the lime utilization was 83.6% which is again lower than that obtained in Example 1.

EXAMPLE 6

Calcium sulfonate (291 g containing 42.4% active material) was diluted with a light hydrocarbon solvent (781 g) and methanol (100 g). To the diluted mixture was added calcium oxide (150 g). The mixture was stirred and heated to 140° F. and then water (38 g) was added. Gaseous carbon dioxide (92 g) was introduced into the mixture over a three hour period. A 100–500 SUS (@ 40° C.) diluent oil (132 g) was then added. The crude reaction mixture contained 9 volume percent solids. The mixture was then filtered through diatomaceous earth and a filtration rate of 2.13 gal of 400 TBN product/hr-ft$^2$ was obtained. The filtrate was then heated to 250° F. to remove the solvent. The solvent-free filtrate (659 g) was bright and clear and had a TBN of 392, a calcium sulfonate content of 17.0, and a Kin Vis @ 100° C. of 42.99 cSt. The sulfonate utilization was 90.7% and the lime utilization was 86.1% which was again lower than that obtained in Example 1.

EXAMPLE 7

Calcium sulfonate (607 g containing 42.4% active material) was diluted with a light hydrocarbon solvent (672 g) and methanol (94 g). To the diluted mixture was added calcium hydroxide (176 g). The mixture was stirred and heated to 140° F. and then gaseous carbon dioxide (79 g) was introduced into the mixture over a two hour period. The crude reaction mixture contained 10 volume percent solids which is more than twice as high as in Example 2. The mixture was then filtered through diatomaceous earth and a filtration rate of only 1.2 gal of 400 TBN product/hr-ft$^2$ was obtained. The filtrate was then heated to 250° F. to remove the solvent. The solvent-free filtrate (758 g) was bright and clear and had a TBN of 291, a calcium sulfonate content of 31.5, and a Kin Vis @ 100° C. of 123.7 cSt. The sulfonate utilization was 92.9% and the lime utilization was 82.6% both of which were lower than that obtained in Example 2.

EXAMPLE 8

Calcium sulfonate (602 g containing 42.4% active material) was diluted with a light hydrocarbon solvent (668 g) and methanol (93 g). To the diluted mixture was added calcium oxide (129 g). The mixture was stirred and heated to 140° F. and then gaseous carbon dioxide (79 g) was introduced into the mixture over a two hour period. The crude reaction mixture contained 8.5 volume percent solids. The mixture was then filtered through diatomaceous earth and a filtration rate of ~18 gal of 400 TBN product/hr-ft$^2$ was obtained. The filtrate was then heated to 250° F. to remove the solvent. The solvent-free filtrate (694 g) was bright and clear and had a TBN of only 237, a calcium sulfonate content of 33.2, and a Kin Vis @ 100° C. of 368.9 cSt. The sulfonate utilization was 90.7% and the lime utilization was 63.7% both of which are lower than that obtained in Example 2.

EXAMPLE 9

Calcium sulfonate (601 g containing 42.4% active material) was diluted with a light hydrocarbon solvent (668 g) and methanol (93 g). To the diluted mixture was added calcium oxide (77 g) and calcium hydroxide (69 g). The mixture was stirred and heated to 140° F. and then gaseous carbon dioxide (79 g) was introduced into the mixture over a two hour period. The crude reaction mixture contained 5 volume percent solids. The mixture was then filtered through diatomaceous earth and a filtration rate of 11.6 gal of 400 TBN product/hr-ft$^2$ was obtained. The filtrate was then heated to 250° F. to remove the solvent. The solvent-free filtrate (798 g) was bright and clear and had a TBN of 289, a calcium sulfonate content of 32.7, and a Kin Vis @ 100° C. of 1055 cSt which is considerably higher than that obtained in Example 2. The sulfonate utilization was 100% and the lime utilization was 89.2%.

EXAMPLE 10

Calcium sulfonate (601 g containing 42.4% active material) was diluted with a light hydrocarbon solvent (668 g) and methanol (92 g). To the diluted mixture was added calcium oxide (128 g). The mixture was stirred and heated to 140° F. and then water (16.5 g) was added. Gaseous carbon dioxide (79 g) was introduced into the mixture over a two hour period. The crude reaction mixture contained 4 volume percent solids. The mixture was then filtered through diatomaceous earth and a filtration rate of only 2.9 gal of 400 TBN product/hr-ft$^2$ was obtained. The filtrate was then heated to 250° F. to remove the solvent. The solvent-free filtrate (781 g) was bright and clear and had a TBN of 297, a calcium sulfonate content of 32.1, and a Kin Vis @ 100° C. of 210 cSt. The sulfonate utilization was 100% and the lime utilization was 86.7%.

EXAMPLE 11

Example 11 illustrates that the rate of the water and carbon dioxide addition must be controlled and synchronized.

Calcium sulfonate (291 g containing 42.4% active material) was diluted with a light hydrocarbon solvent (781 g) and methanol (100 g). To the diluted mixture was added calcium oxide (150 g). The mixture was stirred and heated to 140° F. Gaseous carbon dioxide (92 g) was introduced into the mixture over a three hour period. Sixty minutes after the carbonation was started, the water (38 g) addition was started and the water was added over a two hour period. A 100–500 SUS (@ 40° C.) diluent oil (132 g) was then added. The crude reaction mixture contained 9 volume percent solids. The mixture was then filtered through diatomaceous earth and a filtration rate of 15.1 gal of 400 TBN product/hr-ft$^2$ was obtained. The filtrate was then heated to 250° F. to remove the solvent. The solvent-free filtrate (668 g) was bright and clear and had a TBN of 416, a calcium sulfonate content of 17.8, and a Kin Vis @ 100° C. of 9723 cSt a property which renders this material unsuitable for use as a lubricating oil additive. The sulfonate utilization was 96.5% and the lime utilization was 92.5%.

EXAMPLE 12

Examples 11–16 illustrate the critical nature of the amount of water added.

Calcium sulfonate (327 g containing 42.4% active material) was diluted with a light hydrocarbon solvent (540 g) and methanol (84 g). To the diluted mixture was added calcium oxide (185 g). The mixture was stirred and heated to 140° F. and then gaseous carbon dioxide (116 g) and water (24 g) were introduced into the mixture over a three hour period. A 100–500 SUS (@ 40° C.) diluent oil (160 g) was then added. The crude reaction mixture contained 10 volume percent solids. The mixture was then filtered through diatomaceous earth and a filtration rate of ~3 gal of 400 TBN product/hr-ft$^2$ was obtained. The filtrate was then heated to 250° F. to remove the solvent. The solvent-free filtrate was a gel.

EXAMPLES 13–16

The procedure of Example 11 was repeated for Examples 13–16, tabulated below, with the amount of water varied.

| Example | 12 | 13 | 14 | 15 | 16 |
|---|---|---|---|---|---|
| Water, g | 24 | 35.6 | 47.5 | 59 | 71 |
| Mole Ratio, $H_2O/CaO$ | 0.4 | 0.6 | 0.8 | 1.0 | 1.2 |
| Vol % Solids prior to filtration | 10 | 10 | 10 | 12 | — |
| Filtration Rate, gal/hr-ft$^2$ | ~3 | 1.5 | 3.1 | 2.3 | <0.4 |
| Lime Utilization, % | — | — | 85.0 | 86.2 | — |
| Sulfonate Utilization, % | — | — | 92.5 | 89.3 | — |
| Kin Vis, cSt @ 100° C. | GEL | GEL | 84.8 | 174.8 | 68.3 |
| Carbonation and Hydration Time, hr. | 3 | 3 | 3 | 3 | 3 |

The subject alkaline earth metal carbonate-overbased alkaline earth metal sulfonates, particularly calcium carbonate-overbased calcium sulfonates, are blended in any desired oil of lubricating viscosity to impart detergency and alkaline reserve properties. Such oil may also contain any of the conventional lube oil additives in an amount sufficient for their intended purposes. Generally, the product of the present process will be incorporated in such oils in an effective amount ranging from about 35 to about 80 weight percent of the oil for a concentrate and in an amount from about 0.1 to 20 weight percent based on the amount of neat oil for an oil formulation.

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A process for preparing an overbased oil-soluble calcium sulfonate comprising in order:

(a) diluting a neutral calcium sulfonate with a light hydrocarbon solvent and a lower alkanol;

(b) mixing calcium oxide with the calcium sulfonate;

(c) heating the resulting mixture to about 100° F. to 170° F. at pressure of about 0 to 50 psig;

(d) introducing continuously over a time of about 60 to 240 minutes and at a uniform rate into the heated mixture gaseous carbon dioxide and liquid water in a molar ratio of water/calcium oxide of 0.1 to 1.2;

(e) adding a diluent oil;

(f) separating solids from the liquid; and (g) stripping the solvent from the resulting liquid product.

2. The process of claim 1 wherein the molar ratio of water/calcium oxide is 0.4 to 0.8.

3. The process of claim 1 wherein the time is about 60 to 180 minutes.

4. The process of claim 1 wherein the molar ratio of calcium oxide/neutral calcium sulfonate is about 9 and the molar ratio water/calcium oxide is about 4.

5. The process of claim 1 wherein the molar ratio of calcium oxide/neutral calcium sulfonate is about 21.3 and the molar ratio water/calcium oxide is about 0.8.

* * * * *